US012140024B2

(12) United States Patent
Al Rubaya et al.

(10) Patent No.: US 12,140,024 B2
(45) Date of Patent: Nov. 12, 2024

(54) NON-MAGNETIC OPENHOLE WHIPSTOCK

(71) Applicant: Saudi Arabian Oil Company, Dhahran (SA)

(72) Inventors: Ahmed M. Al Rubaya, Al Khobar (SA); Atallah N. Alharbi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/112,633

(22) Filed: Feb. 22, 2023

(65) Prior Publication Data

US 2024/0279989 A1 Aug. 22, 2024

(51) Int. Cl.

| | |
|---|---|
| ***E21B 7/06*** | (2006.01) |
| ***E21B 33/12*** | (2006.01) |
| ***E21B 33/13*** | (2006.01) |
| ***E21B 47/09*** | (2012.01) |

(52) U.S. Cl.
CPC ..... *E21B 7/061* (2013.01); *E21B 33/12* (2013.01); *E21B 33/13* (2013.01); *E21B 47/09* (2013.01)

(58) Field of Classification Search
CPC ..... E21B 7/061; E21B 33/12; E21B 33/13; E21B 33/134; E21B 47/09; E21B 47/024
See application file for complete search history.

(56) References Cited

U.S. PATENT DOCUMENTS

| | | | | |
|---|---|---|---|---|
| 2,006,556 | A * | 7/1935 | Kothny | E21B 47/024 33/313 |
| 2,196,517 | A * | 4/1940 | Bolton | E21B 7/061 175/81 |
| 3,409,096 | A * | 11/1968 | Brown | E21B 33/138 166/138 |
| 6,315,044 | B1 * | 11/2001 | Tinker | E21B 7/061 175/73 |
| 7,306,056 | B2 | 12/2007 | Ballantyne et al. | |
| 10,597,962 | B2 | 3/2020 | Costa de Oliveira et al. | |
| 11,002,082 | B2 | 5/2021 | Swadi et al. | |
| 11,773,676 | B2 | 10/2023 | Brown-Kerr et al. | |

(Continued)

FOREIGN PATENT DOCUMENTS

| | | |
|---|---|---|
| AU | 2011240646 | 5/2015 |
| AU | 2017225085 | 9/2017 |

(Continued)

*Primary Examiner* — Tara Schimpf
*Assistant Examiner* — Ursula Lee Norris
(74) *Attorney, Agent, or Firm* — Fish & Richardson P.C.

(57) ABSTRACT

A bottomhole assembly (BHA) includes an orientation sub and a non-magnetic whipstock. The orientation sub is configured to receive a gyroscopic orientation tool or is a measurement-while-drilling sub for orienting the orientation sub in a wellbore formed in a subterranean formation. The non-magnetic whipstock is coupled to the orientation sub. The non-magnetic whipstock includes a ramp with a sloped surface that is configured to divert a direction of a drill bit that has drilled through the orientation sub for sidetracking from the wellbore and forming a secondary wellbore in the subterranean formation. The ramp defines a set of ports that are configured to allow cement to permeate throughout the ramp for securing the non-magnetic whipstock in the wellbore before diverting the direction of the drill bit.

18 Claims, 7 Drawing Sheets

(56) References Cited

U.S. PATENT DOCUMENTS

| | | | | |
|---|---|---|---|---|
| 2007/0240876 | A1* | 10/2007 | Lynde | E21B 7/061 166/117.6 |
| 2014/0338908 | A1* | 11/2014 | Ervin | E21B 17/042 166/113 |
| 2018/0223614 | A1* | 8/2018 | Hern | E21B 23/04 |
| 2018/0238145 | A1 | 8/2018 | Head | |
| 2021/0017854 | A1 | 1/2021 | Fang | |

FOREIGN PATENT DOCUMENTS

| | | |
|---|---|---|
| CN | 1628207 | 6/2005 |
| RU | 2649711 | 4/2018 |
| WO | WO 2011130350 | 10/2011 |
| WO | WO 2015103182 | 7/2015 |

* cited by examiner

500

NON-MAGNETIC OPENHOLE WHIPSTOCK

TECHNICAL FIELD

This disclosure relates to drilling wellbores, and more particularly to drilling sidetrack wellbores.

BACKGROUND

A sidetrack wellbore is a secondary, deviated wellbore that extends from a main wellbore. Sidetrack wellbores can be used to extract hydrocarbons from an alternate subterranean zone or formation, or to remedy a problem existing in the main wellbore. To drill a sidetrack wellbore, the existing open hole or perforations from main wellbore is plugged with cement and then a whipstock is used to deflect a drill bit from the cement plug, from above of plugged main wellbore. The whipstock allows the drill bit to drill a sidetrack wellbore in a desired direction and location with respect to the main wellbore.

SUMMARY

This disclosure describes technologies relating to drilling sidetrack wellbores. Certain aspects of the subject matter described can be implemented as a method. A stinger pipe is coupled to an orientation sub that is positioned in a wellbore formed in a subterranean formation. The orientation sub is coupled to a non-magnetic whipstock that is configured to rotate with the orientation sub. The non-magnetic whipstock includes a ramp that defines a set of ports. A gyroscopic orientation tool is coupled to the orientation sub. The gyroscopic orientation tool is configured to detect an orientation of the orientation sub in the wellbore. The orientation sub is rotated to match a specified orientation specified by the gyroscopic orientation tool. The gyroscopic orientation tool is removed from the orientation sub. Cement is flowed through the stinger pipe and through the orientation sub to the non-magnetic whipstock. The non-magnetic whipstock is reciprocated, thereby facilitating the cement to permeate through the non-magnetic whipstock via the ports. A drill bit is rotated through the orientation sub. After rotating the drill bit through the orientation sub, the drill bit is directed through the cement and against the sloped surface of the ramp of the non-magnetic whipstock, thereby diverting a direction of the drill bit. After diverting the direction of the drill bit, the drill bit is rotated into the subterranean formation to sidetrack from the wellbore and form a secondary wellbore in the subterranean formation.

This, and other aspects, can include one or more of the following features. The stinger pipe can include a ball seat. The ball seat can define an inner bore. Flowing the cement through the stinger pipe can include flowing the cement through the inner bore defined by the ball seat. After reciprocating the non-magnetic whipstock, the method can include waiting for a specified time duration to allow the cement to set, thereby securing the non-magnetic whipstock in the wellbore. After allowing the cement to set and before rotating the drill bit through the orientation sub, a ball can be dropped onto the ball seat, thereby obstructing the inner bore defined by the ball seat and preventing the cement from flowing through the inner bore defined by the ball seat. The stinger pipe can include a shear pin. The shear pin can be configured to keep the stinger pipe coupled to the orientation sub while the shear pin is intact. After dropping the ball and before rotating the drill bit through the orientation sub, the shear pin can be sheared to decouple the stinger pipe from the orientation sub. After shearing the shear pin and before rotating the drill bit through the orientation sub, the stinger pipe can be pulled out of the wellbore. The stinger pipe can include a second ball seat. The second ball seat can define a second inner bore having a larger cross-sectional flow area than the inner bore defined by the ball seat. Flowing the cement through the stinger pipe can include flowing the cement through the second inner bore defined by the second ball seat. After allowing the cement to set and before rotating the drill bit through the orientation sub, a second ball can be dropped onto the second ball seat, thereby obstructing the second inner bore defined by the second ball seat and preventing the cement from flowing through the second inner bore defined by the second ball seat. The second ball can have a larger diameter than the ball. The non-magnetic whipstock can include a cylindrical portion connected to the ramp. The cylindrical portion can define a second set of ports. The second set of ports can be configured to allow cement to permeate throughout the cylindrical portion for further securing the non-magnetic whipstock in the wellbore before diverting the direction of the drill bit. The non-magnetic whipstock can be made of a mixture of precast cement and at least one of carbon fiber, fiberglass, polymer, plastic, or ceramic.

Certain aspects of the subject matter described can be implemented as a bottomhole assembly (BHA). The BHA includes an orientation sub and a non-magnetic whipstock. The orientation sub is configured to receive a gyroscopic orientation tool for orienting the orientation sub in a wellbore formed in a subterranean formation. The non-magnetic whipstock is coupled to the orientation sub. The non-magnetic whipstock is configured to rotate with the orientation sub. The non-magnetic whipstock includes a ramp. The ramp includes a sloped surface. The sloped surface is configured to divert a direction of a drill bit that has drilled through the orientation sub for sidetracking from the wellbore and forming a secondary wellbore in the subterranean formation. The ramp defines a set of ports. The ports are configured to allow cement to permeate throughout the ramp for securing the non-magnetic whipstock in the wellbore before diverting the direction of the drill bit.

This, and other aspects, can include one or more of the following features. The BHA can include a stinger pipe. The stinger pipe can be configured to reversibly couple to the orientation sub. The stinger pipe can include a ball seat. The ball seat can define an inner bore. The ball seat can be configured to receive a ball. Before receiving the ball, cement can be allowed to flow through the inner bore defined by the ball seat. After receiving the ball, cement can be prevented from flowing through the inner bore defined by the ball seat. The stinger pipe can include a shear pin. The shear pin can be configured to keep the stinger pipe coupled to the orientation sub while the shear pin is intact. The stinger pipe can be configured to decouple from the orientation sub in response to the shear pin being sheared. The stinger pipe can include a second ball seat. The second ball seat can define a second inner bore. The second ball seat can be configured to receive a second ball. Before receiving the second ball, cement can be allowed to flow through the second inner bore defined by the second ball seat. After receiving the second ball, cement can be prevented from flowing through the second inner bore defined by the second ball seat. The second ball can have a larger diameter than the ball. The second inner bore defined by the second ball seat can have a larger cross-sectional flow area than the inner bore defined by the ball seat. The non-magnetic whipstock can include a cylindrical portion. The cylindrical portion can be connected to the ramp. The cylindrical portion can define a second set of ports. The second set of ports can be configured to allow cement to permeate throughout the cylindrical portion for further securing the non-magnetic whipstock in the wellbore before diverting the direction of the drill bit. The non-magnetic whipstock can be made of a material having a hardness greater than cement and greater than the subterranean formation. The non-magnetic whipstock can be made of a mixture of precast cement and at least one of carbon fiber, fiberglass, polymer, plastic, or ceramic.

Certain aspects of the subject matter described can be implemented as a system. The system includes a wellbore, an orientation sub, a stinger pipe, and a non-magnetic whipstock. The wellbore is formed in a subterranean formation. The orientation sub is positioned in the wellbore. The orientation sub is configured to receive a gyroscopic orientation tool for orienting the orientation sub in the wellbore. The stinger pipe is reversibly coupled to the orientation sub. The stinger pipe includes a shear pin and a ball seat. The shear pin is configured to keep the stinger pipe coupled to the orientation sub while the shear pin is intact. The stinger pipe is configured to decouple from the orientation sub in response to the shear pin being sheared. The ball seat defines an inner bore. The ball seat is configured to receive a ball. Before receiving the ball, cement is allowed to flow through the inner bore defined by the ball seat. After receiving the ball, cement is prevented from flowing through the inner bore defined by the ball seat. The non-magnetic whipstock is coupled to the orientation sub. The non-magnetic whipstock is configured to rotate with the orientation sub. The non-magnetic whipstock includes a ramp. The ramp includes a sloped surface. The sloped surface is configured to divert a direction of a drill bit that has drilled through the orientation sub for sidetracking from the wellbore and forming a secondary wellbore in the subterranean formation. The ramp defines a set of ports. The ports are configured to allow cement to permeate throughout the ramp for securing the non-magnetic whipstock in the wellbore before diverting the direction of the drill bit.

This, and other aspects, can include one or more of the following features. The non-magnetic whipstock can include a cylindrical portion. The cylindrical portion can be connected to the ramp. The cylindrical portion can define a second set of ports. The second set of ports can be configured to allow cement to permeate throughout the cylindrical portion for further securing the non-magnetic whipstock in the wellbore before diverting the direction of the drill bit. The non-magnetic whipstock can be made of a mixture of precast cement and at least one of carbon fiber, fiberglass, polymer, plastic, or ceramic.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes a bottomhole assembly and method for forming a sidetrack wellbore from an existing wellbore. The bottomhole assembly includes an orientation sub and a whipstock. A gyroscopic orientation tool can couple to the orientation sub and be used to orient the bottomhole assembly in a general direction in which sidetracking from the existing wellbore to form a secondary (sidetrack) wellbore is desired. The whipstock is non-magnetic, such that it does not interfere with measurement while drilling (MWD) operations.

The subject matter described in this disclosure can be implemented in particular implementations, so as to realize one or more of the following advantages. For example, the bottomhole assembly described can save time and resources by plugging a wellbore and drilling a sidetrack wellbore all during one trip. The bottomhole assembly described includes a whipstock that can be utilized without a packer, thereby achieving significant cost savings compared to utilizing a whipstock with a packer. The bottomhole assembly described includes a whipstock that is non-magnetic, such that the whipstock does not interfere with MWD operations, and accurate well azimuth and inclination readings can be obtained and analyzed in real time. In some implementations, the whipstock is made of a non-metallic material, which can be cheaper to construct in comparison to whipstocks made of soft metals or metal alloys. The bottomhole assembly described includes a whipstock that can be fabricated in molds (for example, precast) independent of precision machining, which can save on costs and time in comparison to whipstocks that require precision machining fabrication. The bottomhole assembly described includes a whipstock that can be implemented directly with cement plugs, in contrast to conventional whipstocks that are not typically implemented with cement. The bottomhole assembly described includes directional capabilities and can be implemented with a drill bit independent of a specifically dedicated milling run, which can save both time and costs associated with sidetracking operations. The bottomhole assembly described can be implemented with a cement kick-off plug, such that a specifically dedicated cementing run is not separately required. The bottomhole assembly described includes a whipstock that defines ports, which can improve the cementing bond between the cement and the whipstock and also the cementing bond between the cement and the wall of the wellbore, thereby improving reliability of the whipstock taking the required weight of bit (WOB) during sidetracking operations. The bottomhole assembly described includes a stinger pipe that includes a shear pin that can be shared by deployment of a ball as opposed to conventional shear bolts, which can disadvantageously fail if slight drag is encountered or if a weight on bit that is lighter than the required weight on bit is applied.

Figure 1:
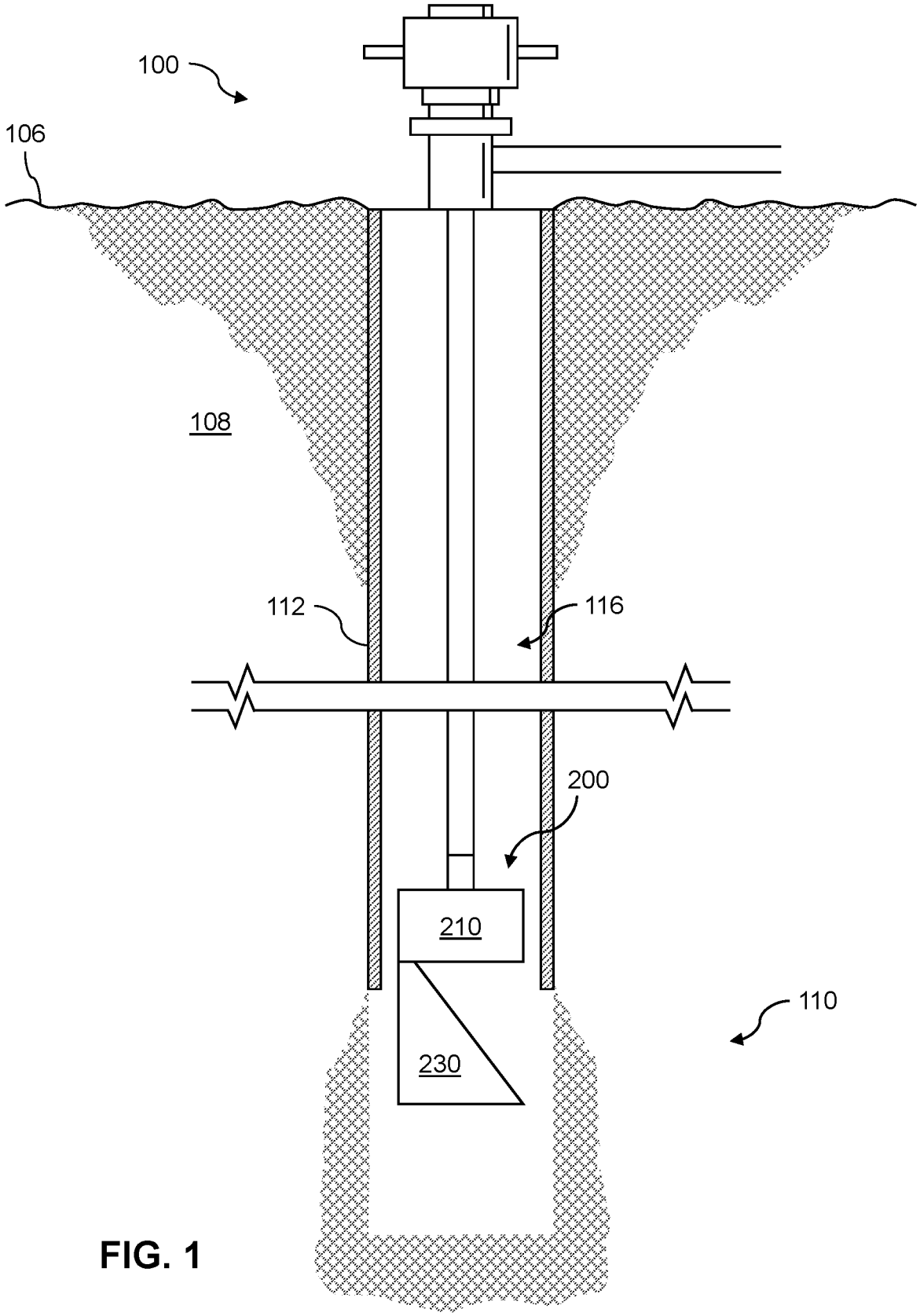
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly) end-to-end. In FIG. 1, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110. This portion of the well 100 without casing is often referred to as "open hole."

The wellhead defines an attachment point for other equipment to be attached to the well 100. For example, FIG. 1 shows well 100 being produced with a Christmas tree attached to the wellhead. The Christmas tree includes valves used to regulate flow into or out of the well 100. In particular, casing 112 is commercially produced in a number of common sizes specified by the American Petroleum Institute (the "API"), including 4-½, 5, 5-½, 6, 6-⅝, 7, 7-⅝, 7-¾, 8-⅝, 8-¾, 9-⅝, 9-¾, 9-⅞, 10-¾, 11-¾, 11-⅞, 13-⅜, 13-½, 13-⅝, 16, 18-⅝, and 20 inches, and the API specifies internal diameters for each casing size.

A bottomhole assembly 200 can be deployed in the well 100. The bottomhole assembly 200 can be used to sidetrack the well 100 to form a secondary wellbore. The bottomhole assembly 200 includes an orientation sub 210 and a non-magnetic whipstock 220. In some implementations, the non-magnetic whipstock 220 is also non-metallic. The orientation sub 210 is configured to receive a gyroscopic orientation tool for orienting the orientation sub 210 in the wellbore of the well 100. The non-magnetic whipstock 220 is coupled to the orientation sub 210. The non-magnetic whipstock 220 is configured to rotate with the orientation sub 210. Once deployed in the well 100, the non-magnetic whipstock 220 can be rotated to a desired orientation in the well 100. Once the non-magnetic whipstock 220 is in the desired location and orientation in the well 100, the non-magnetic whipstock 220 can be secured in the well 100, for example, by cementing the non-magnetic whipstock 220 in the well 100. Once the non-magnetic whipstock 220 is secured in the well 100, a drill bit can be directed to the non-magnetic whipstock 220, and the non-magnetic whipstock 220 can divert a direction of the drill bit to sidetrack the well 100 and form a secondary wellbore. The bottomhole assembly 200 is also shown in FIG. 2 and is described in more detail later.

Figure 2:
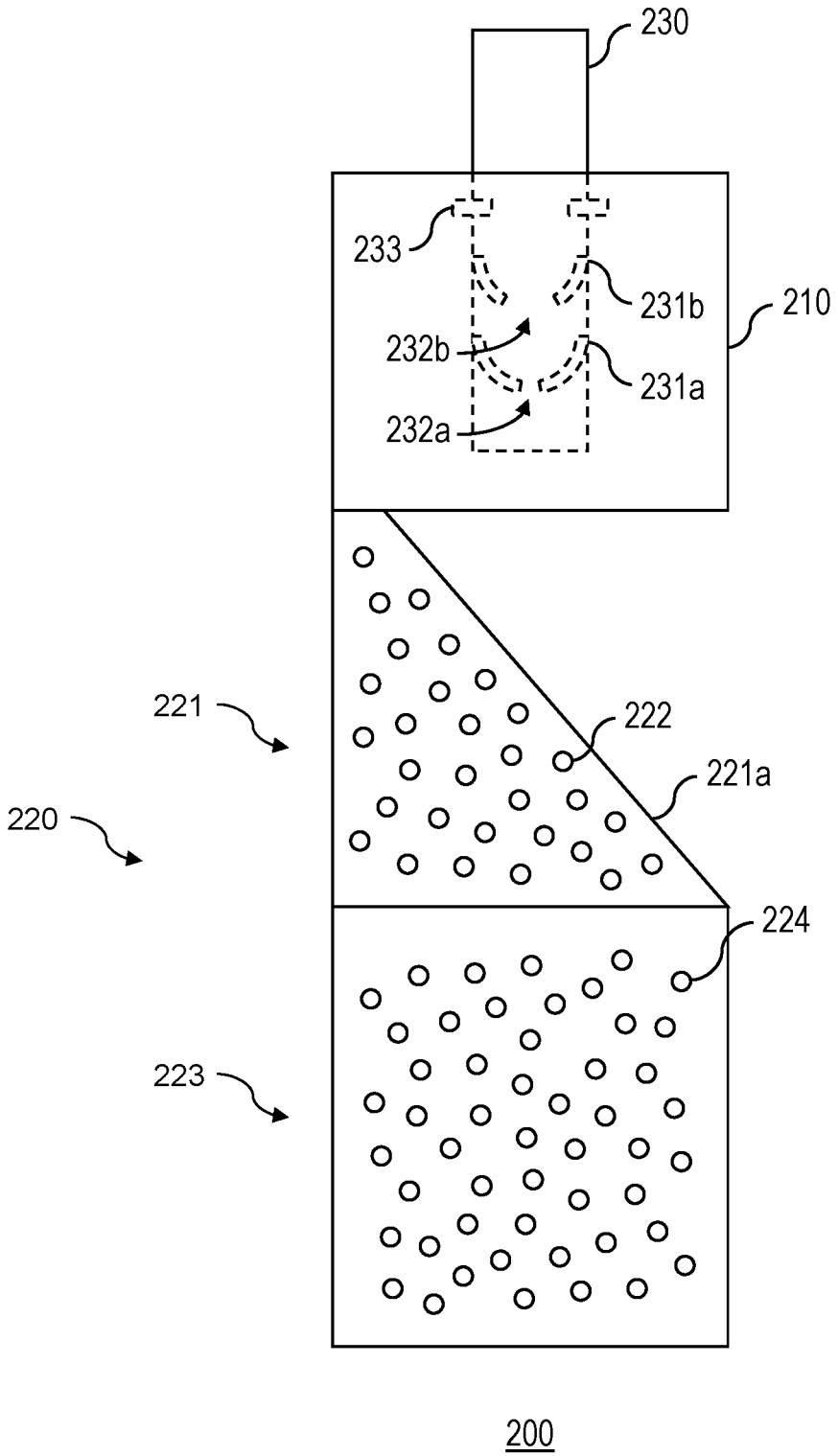
FIG. 2 is a schematic diagram of an example bottomhole assembly that can be used to sidetrack a well.

FIG. 2 is a schematic diagram of the bottomhole assembly 200 that can be used to sidetrack a well, such as the well 100. As mentioned previously, the bottomhole assembly 200 includes the orientation sub 210 and the non-magnetic whipstock 220. The non-magnetic whipstock 220 includes a ramp 221 that includes a sloped surface 221*a*. The sloped surface 221*a* of the ramp 221 is configured to divert a direction of a drill bit for sidetracking from the wellbore of the well 100 to form a secondary wellbore. The ramp 221 defines multiple ports 222 that are configured to allow cement to permeate throughout the ramp 221 for securing the non-magnetic whipstock 220 in the wellbore before diverting the direction of the drill bit. In some implementations, at least a portion of the non-magnetic whipstock 220 (for example, at least the ramp 221) is made of a material having a hardness greater than cement and greater than the subterranean formation. In some implementations, at least a portion of the non-magnetic whipstock 220 is made of a mixture of precast cement and at least one of carbon fiber, fiberglass, plastic, or ceramic. For example, the ramp 221 or all of the non-magnetic whipstock 220 is made of a mixture of precast cement and at least one of carbon fiber, fiberglass, plastic, or ceramic.

The bottomhole assembly 200 can include a stinger pipe 230 configured to reversibly couple to the orientation sub 210. In some implementations, the stinger pipe 230 includes a ball seat 231*a* defining an inner bore 232*a*. The ball seat 231*a* can be configured to receive a ball. Before receiving the ball, cement is allowed to flow through the inner bore 232*a* defined by the ball seat 231*a*. After receiving the ball, cement is prevented from flowing through the inner bore 232*a* defined by the ball seat 231*a*. In some implementations, the stinger pipe 230 includes a shear pin 233. The shear pin 233 can be configured to keep the stinger pipe 230 coupled to the orientation sub 210 while the shear pin 233 is intact. The stinger pipe 230 can be configured to decouple from the orientation sub 210 in response to the shear pin 233 being sheared.

In some implementations, the stinger pipe 230 includes a second ball seat 231*b* defining a second inner bore 232*b*. The second ball seat 231*b* can be configured to receive a second ball. Before receiving the second ball, cement is allowed to flow through the second inner bore 232*b* defined by the second ball seat 231*b*. After receiving the second ball, cement is prevented from flowing through the second inner bore 232*b* defined by the second ball seat 231*b*. The second ball can have a larger diameter than the first ball received by the ball seat 231*a*. The second inner bore 232*b* defined by the second ball seat 231*b* can have a larger cross-sectional flow area than the inner bore 232*a* defined by the ball seat 231*a*. The second ball seat 231*b* can be considered a secondary ball seat that is used for contingency in case the ball seat 231*a* does not perform its desired function of stopping the flow of cement through the stinger pipe 230 once the ball has been dropped onto the ball seat 231*a*. For example, after the ball has been dropped onto the ball seat 231*a*, and it is detected that cement is still flowing through the stinger pipe 230 (undesired result), then the second ball can be dropped onto the second ball seat 231*b* to obstruct the flow of cement through the stinger pipe 230.

In some implementations, the non-magnetic whipstock 220 includes a cylindrical portion 223 that is connected to the ramp 221. The cylindrical portion 223 can define ports 224 that are similar to the ports 222 of the ramp 221. The ports 224 of the cylindrical portion 223 are configured to allow cement to permeate throughout the cylindrical portion 223 for further securing the non-magnetic whipstock 223 in the wellbore before diverting the direction of the drill bit.

The drill bit can be a part of a drill string that extends from the surface 106 and receives fluid from or near the surface 106. For example, the drill string can be connected to a mud pump or similar equipment at the surface 106. The drill string includes one or more drill pipes that flows drilling fluid from the surface 106 to a downhole location of the wellbore (for example, to the location at which the sidetrack wellbore is to be formed). The drill string is connected to a milling system that includes the drill bit. The drill bit is rotated while drilling fluid is supplied from the surface 106. As the drill bit rotates and cuts into the subterranean formation, the sidetrack wellbore is formed.

Figure 3A:
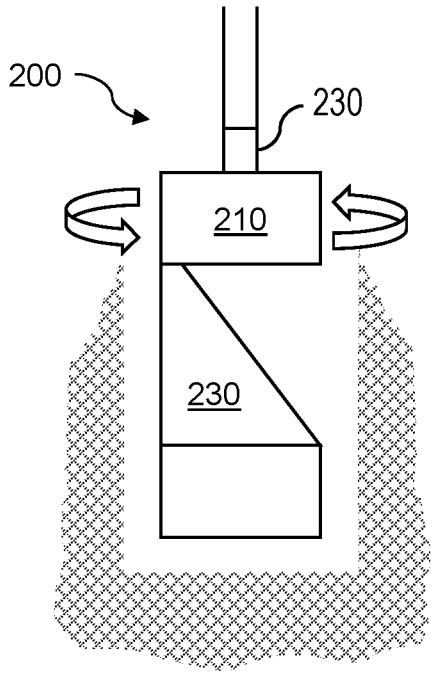
FIGS. 3A, 3B, 3C, 3D, and 3E depict a progression of sidetracking a well using the bottomhole assembly of FIG. 2.
Figure 3B:
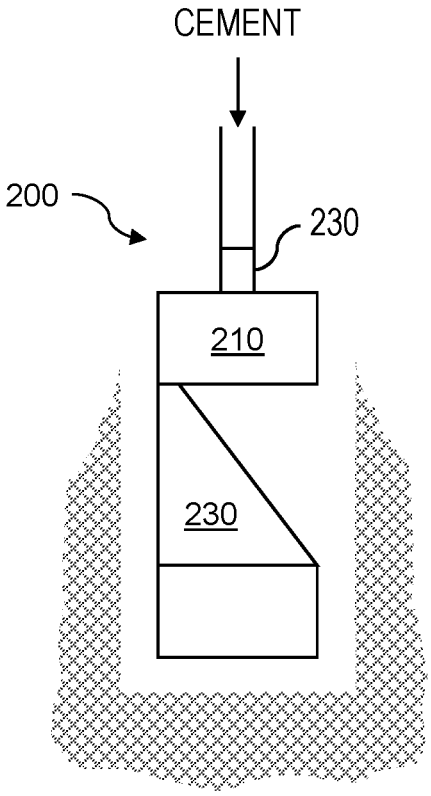
Figure 3C:
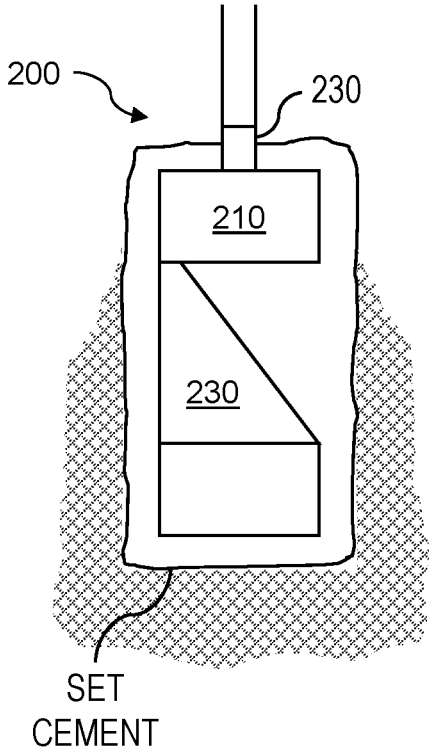
Figure 3D:
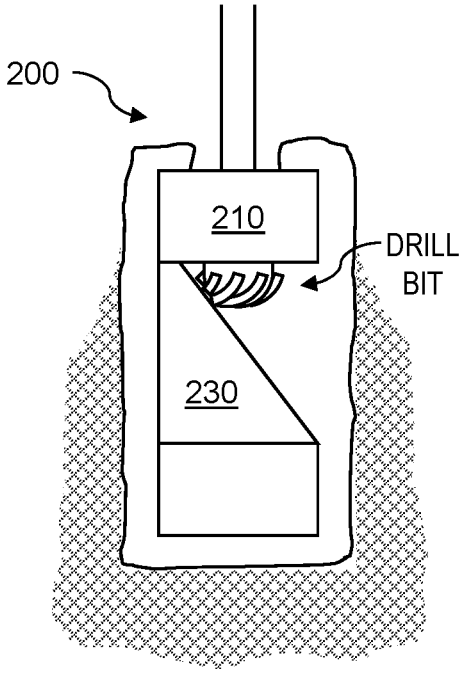
Figure 3E:
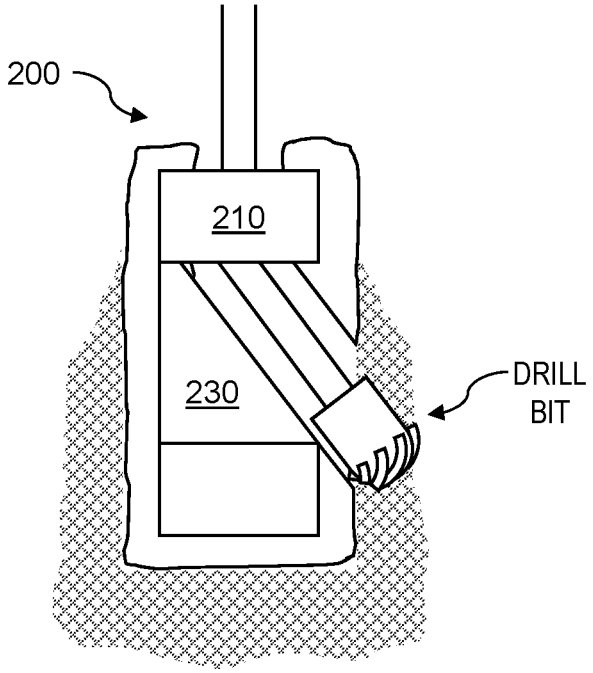

FIGS. 3A, 3B, 3C, 3D, and 3E depict a progression of sidetracking a well, such as the well 100, using the bottomhole assembly 200. In FIG. 3A, the bottomhole assembly 200 has been placed at the desired downhole location and rotated to the desired orientation in the wellbore of the well 100. In FIG. 3B, cement is flowed through the stinger pipe 230 and through the orientation sub 210 to the non-magnetic whipstock 220. The cement is allowed to set, thereby securing the non-magnetic whipstock 220 in the well 100. In FIG. 3C, the non-magnetic whipstock 220 has been cemented in the well 100. In FIG. 3D, the stinger pipe 230 has been decoupled from the orientation sub 210, and a drill bit has drilled through the orientation sub 210. In FIG. 3E, the sloped surface 221*a* of the ramp 221 of the non-magnetic whipstock 220 has diverted a direction of the drill bit, and the drill bit has sidetracked from the original wellbore of the well 100, thereby forming a secondary wellbore.

Figure 4:
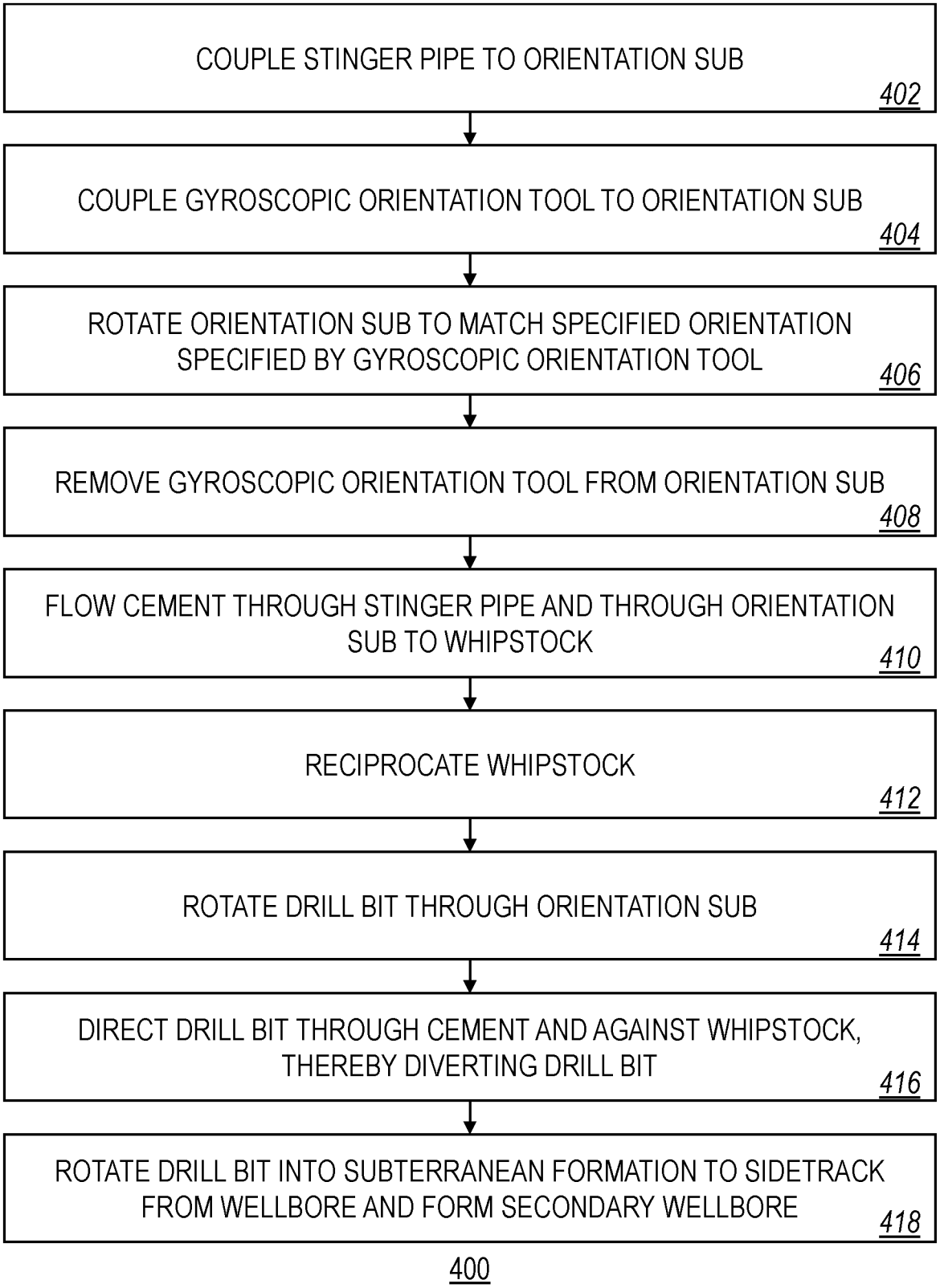
FIG. 4 is a flow chart of an example method for sidetracking a well.

FIG. 4 is a flow chart of an example method 400 for sidetracking a well, such as the well 100. The bottomhole assembly 200 can, for example, be used to implement the method 400. At block 402, a stinger pipe (such as the stinger pipe 230) is coupled to an orientation sub (such as the orientation sub 210) positioned in a wellbore formed in a subterranean formation (such as the wellbore of the well 100). As described previously, the orientation sub 210 is coupled to a non-magnetic whipstock 220 configured to rotate with the orientation sub 210, and the non-magnetic whipstock 220 includes a ramp 221 defining ports 222. At block 404, a gyroscopic orientation tool is coupled to the orientation sub 210. The gyroscopic orientation tool coupled to the orientation sub 210 at block 404 is configured to detect an orientation of the orientation sub 210 in the wellbore. The gyroscopic orientation tool can, for example, be used to orient the non-magnetic whipstock 220 in a vertical wellbore. At block 406, the orientation sub 210 is rotated to match a specified orientation specified by the gyroscopic orientation tool. For example, the orientation sub 210 is rotated at block 406, such that the sloped surface 221*a* of the ramp 221 of the non-magnetic whipstock 220 is generally oriented toward a direction in which sidetracking from the wellbore is desired (for example, toward a desired direction in which a secondary wellbore sidetracking from the original wellbore is to be formed). At block 408, the gyroscopic orientation tool is removed from the orientation sub 210. At block 410, cement is flowed through the stinger pipe 230 and through the orientation sub 210 to the non-magnetic whipstock 220. Flowing cement through the stinger pipe 230 at block 410 can include flowing cement through the inner bore 232*a* defined by the ball seat 231*a*. Flowing cement through the stinger pipe 230 at block 410 can include flowing cement through the second inner bore 232*b* defined by the second ball seat 231*b*. At block 412, the non-magnetic whipstock 220 is reciprocated (for example, moved back and forth switching from uphole and downhole directions), thereby facilitating the cement (flowed at block 410) to permeate through the non-magnetic whipstock 220 via the ports 222. Reciprocating the non-magnetic whipstock 220 at block 412 causes the cement (flowed at block 410) to permeate throughout the non-magnetic whipstock 220 and fill the ports 222. In cases in which the non-magnetic whipstock 220 includes the cylindrical portion 223 connected to the ramp 221, the cement can also permeate through the cylindrical portion 223 via the ports 224, which can further facilitate securing the non-magnetic whipstock 220 in the wellbore. After reciprocating the non-magnetic whipstock 220 at block 412, the cement can be allowed to set, thereby securing the non-magnetic whipstock 220 in the wellbore. In some implementations, the cement is allowed to set by waiting a specified time duration, which can be considered a cement thickening time duration. The cement thickening time duration can depend on various factors, such as cement pumping flow rate, hole depth, piping volumes, downhole conditions (such as downhole temperature), cement volumes, or any combinations of these. By allowing the cement to set for the cement thickening time duration, the cement can sufficiently wet the non-magnetic whipstock 220 around all sides for effective anchoring in the wellbore. In some cases, if the cement is not allowed to set for a sufficient time duration (for example, less than the cement thickening time duration), then the cement may set later into the sidetracking operation, which can be disadvantageous. In some cases, if the cement is allowed to set for too long past the cement thickening time duration, the cement may run the risk of getting lost in hole and lose homogeneous strength. In some implementations, after allowing the cement to set and before proceeding to block 414, a ball can be dropped onto the ball seat 231*a*, thereby obstructing the inner bore 232*a* defined by the ball seat 231*a* and preventing cement from flowing through the inner bore 232*a* defined by the ball seat 231*a*. In some implementations, after allowing the cement to set and before proceeding to block 414, a second ball can be dropped onto the second ball seat 231*b*, thereby obstructing the second inner bore 232*b* defined by the second ball seat 231*b* and preventing cement from flowing through the second inner bore 232*b* defined by the second ball seat 231*b*. In some implementations, after dropping the ball and before proceeding to block 414, the shear pin 233 is sheared to decouple the stinger pipe 230 from the orientation sub 210. In some implementations, after shearing the shear pin 233 and before proceeding to block 414, the stinger pipe 230 is pulled out of the wellbore. At block 414, a drill bit is rotated through the orientation sub 210. Thus, the orientation sub 210 is drilled through at block 414. After the drill bit is rotated through the orientation sub 210 at block 414, the drill bit is directed through the cement and against the sloped surface 221*a* of the ramp 221 of the non-magnetic whipstock 220 at block 416. Directing the drill bit against the sloped surface 221*a* of the ramp 221 of the non-magnetic whipstock 220 at block 416 causes a direction of the drill bit to be diverted. The ramp 221 of the non-magnetic whipstock 220 (which is made of a material that is harder than cement and the rock making up the subterranean formation) forces the drill bit to change its direction due to the hardness of the ramp 221. After diverting the direction of the drill bit at block 416, the drill bit is rotated into the subterranean formation at block 418 to sidetrack from the wellbore and form a secondary wellbore in the subterranean formation.

Figure 5:
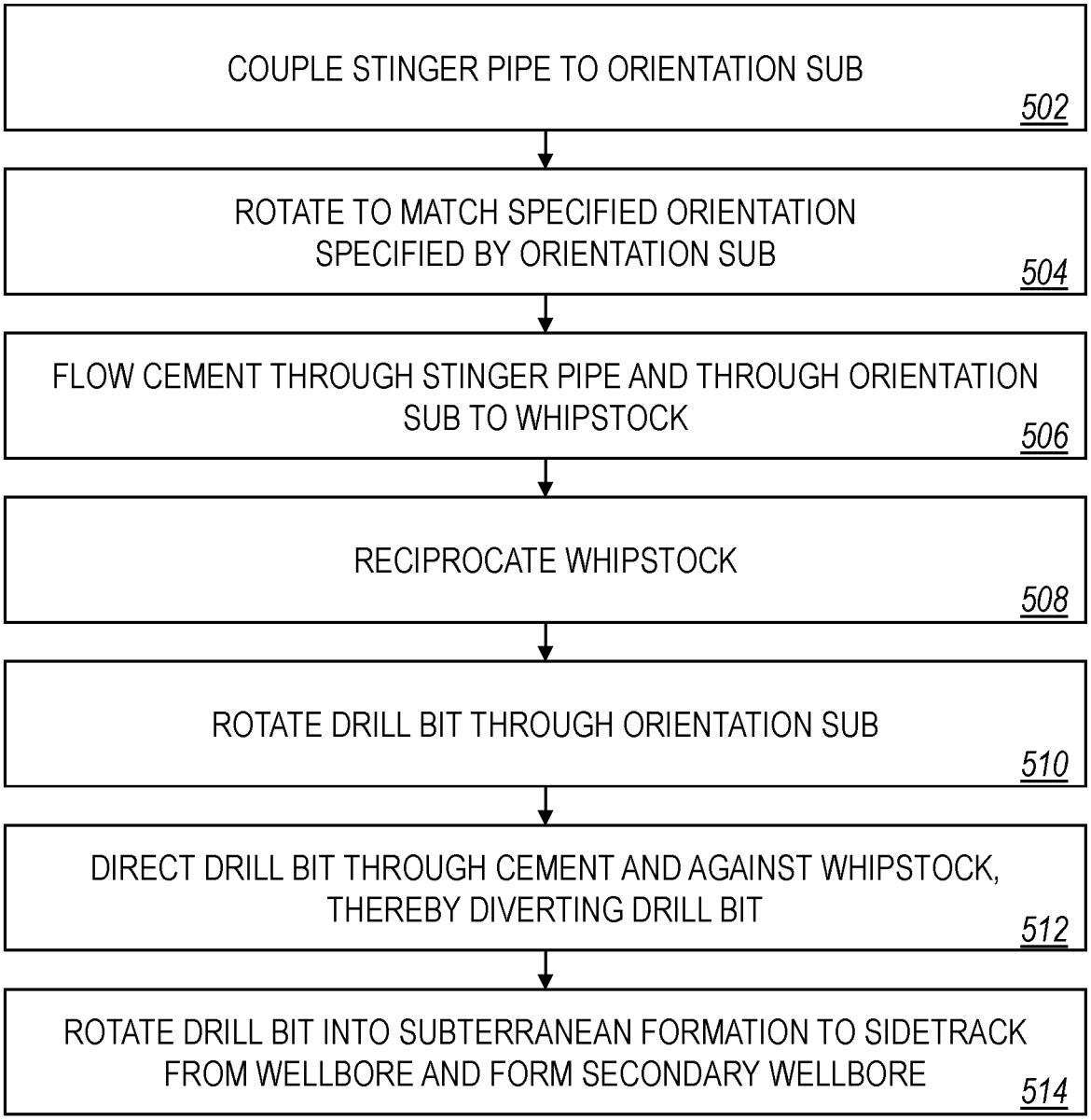
FIG. 5 is a flow chart of an example method for sidetracking a well.

FIG. 5 is a flow chart of an example method 500 for sidetracking a well, such as the well 100. The bottomhole assembly 200 can, for example, be used to implement the method 500. At block 502, a stinger pipe (such as the stinger pipe 230) is coupled to an orientation sub (such as the orientation sub 210) positioned in a wellbore formed in a subterranean formation (such as the wellbore of the well 100). As described previously, the orientation sub 210 is coupled to a non-magnetic whipstock 220 configured to rotate with the orientation sub 210, and the non-magnetic whipstock 220 includes a ramp 221 defining ports 222. The orientation sub 210 can be a measurement-while-drilling (MWD) sub that is configured to detect an orientation of the orientation sub 210 in the wellbore. The MWD sub can, for example, be used to orient the non-magnetic whipstock 220 in a deviated wellbore (such as a horizontal wellbore). At block 504, the orientation sub 210 is rotated to match a specified orientation specified by the orientation sub 210 (MWD sub). For example, the orientation sub 210 is rotated at block 504, such that the sloped surface 221*a* of the ramp 221 of the non-magnetic whipstock 220 is generally oriented toward a direction in which sidetracking from the wellbore is desired (for example, toward a desired direction in which a secondary wellbore sidetracking from the original wellbore is to be formed). At block 506, cement is flowed through the stinger pipe 230 and through the orientation sub 210 to the non-magnetic whipstock 220. Flowing cement through the stinger pipe 230 at block 506 can include flowing cement through the inner bore 232*a* defined by the ball seat 231*a*. Flowing cement through the stinger pipe 230 at block 506 can include flowing cement through the second inner bore 232*b* defined by the second ball seat 231*b*. At block 508, the non-magnetic whipstock 220 is reciprocated (for example, moved back and forth switching from uphole and downhole directions), thereby facilitating the cement (flowed at block 506) to permeate through the non-magnetic whipstock 220 via the ports 222. Reciprocating the non-magnetic whipstock 220 at block 508 causes the cement (flowed at block 506) to permeate throughout the non-magnetic whipstock 220 and fill the ports 222. In cases in which the non-magnetic whipstock 220 includes the cylindrical portion 223 connected to the ramp 221, the cement can also permeate through the cylindrical portion 223 via the ports 224, which can further facilitate securing the non-magnetic whipstock 220 in the wellbore. After reciprocating the non-magnetic whipstock 220 at block 508, the cement can be allowed to set, thereby securing the non-magnetic whipstock 220 in the wellbore. In some implementations, the cement is allowed to set by waiting a specified time duration, which can be considered a cement thickening time duration. The cement thickening time duration can depend on various factors, such as cement pumping flow rate, hole depth, piping volumes, downhole conditions (such as downhole temperature), cement volumes, or any combinations of these. By allowing the cement to set for the cement thickening time duration, the cement can sufficiently wet the non-magnetic whipstock 220 around all sides for effective anchoring in the wellbore. In some cases, if the cement is not allowed to set for a sufficient time duration (for example, less than the cement thickening time duration), then the cement may set later into the sidetracking operation, which can be disadvantageous. In some cases, if the cement is allowed to set for too long past the cement thickening time duration, the cement may run the risk of getting lost in hole and lose homogeneous strength. In some implementations, after allowing the cement to set and before proceeding to block 510, a ball can be dropped onto the ball seat 231*a*, thereby obstructing the inner bore 232*a* defined by the ball seat 231*a* and preventing cement from flowing through the inner bore 232*a* defined by the ball seat 231*a*. In some implementations, after allowing the cement to set and before proceeding to block 510, a second ball can be dropped onto the second ball seat 231*b*, thereby obstructing the second inner bore 232*b* defined by the second ball seat 231*b* and preventing cement from flowing through the second inner bore 232*b* defined by the second ball seat 231*b*. In some implementations, after dropping the ball and before proceeding to block 510, the shear pin 233 is sheared to decouple the stinger pipe 230 from the orientation sub 210. In some implementations, after shearing the shear pin 233 and before proceeding to block 510, the stinger pipe 230 is pulled out of the wellbore. At block 510, a drill bit is rotated through the orientation sub 210. Thus, the orientation sub 210 is drilled through at block 510. After the drill bit is rotated through the orientation sub 210 at block 510, the drill bit is directed through the cement and against the sloped surface 221*a* of the ramp 221 of the non-magnetic whipstock 220 at block 512. Directing the drill bit against the sloped surface 221*a* of the ramp 221 of the non-magnetic whipstock 220 at block 512 causes a direction of the drill bit to be diverted. The ramp 221 of the non-magnetic whipstock 220 (which is made of a material that is harder than cement and the rock making up the subterranean formation) forces the drill bit to change its direction due to the hardness of the ramp 221. After diverting the direction of the drill bit at block 512, the drill bit is rotated into the subterranean formation at block 514 to sidetrack from the wellbore and form a secondary wellbore in the subterranean formation.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any subcombination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

coupling a stinger pipe to an orientation sub positioned in a wellbore formed in a subterranean formation, wherein the orientation sub is coupled to a non-magnetic whipstock configured to rotate with the orientation sub, the non-magnetic whipstock comprising a ramp defining a plurality of ports;

coupling a gyroscopic orientation tool to the orientation sub, the gyroscopic orientation tool configured to detect an orientation of the orientation sub in the wellbore;

rotating the orientation sub to match a specified orientation specified by the gyroscopic orientation tool;

removing the gyroscopic orientation tool from the orientation sub;

flowing cement through the stinger pipe and through the orientation sub to the non-magnetic whipstock;

reciprocating the non-magnetic whipstock, thereby facilitating the cement to permeate through the non-magnetic whipstock via the plurality of ports;

rotating a drill bit through the orientation sub;

after rotating the drill bit through the orientation sub, directing the drill bit through the cement and against the sloped surface of the ramp of the non-magnetic whipstock, thereby diverting a direction of the drill bit; and after diverting the direction of the drill bit, rotating the drill bit into the subterranean formation to sidetrack from the wellbore and form a secondary wellbore in the subterranean formation.

2. The method of claim 1, wherein the stinger pipe comprises a ball seat defining an inner bore, and flowing the cement through the stinger pipe comprises flowing the cement through the inner bore defined by the ball seat.

3. The method of claim 2, comprising:

after reciprocating the non-magnetic whipstock, waiting a specified time duration to allow the cement to set, thereby securing the non-magnetic whipstock in the wellbore; and after allowing the cement to set and before rotating the drill bit through the orientation sub, dropping a ball onto the ball seat, thereby obstructing the inner bore defined by the ball seat and preventing the cement from flowing through the inner bore defined by the ball seat.

4. The method of claim 3, wherein the stinger pipe comprises a shear pin configured to keep the stinger pipe coupled to the orientation sub while the shear pin is intact.

5. The method of claim 4, comprising, after dropping the ball and before rotating the drill bit through the orientation sub, shearing the shear pin to decouple the stinger pipe from the orientation sub.

6. The method of claim 5, comprising, after shearing the shear pin and before rotating the drill bit through the orientation sub, pulling the stinger pipe out of the wellbore.

7. The method of claim 6, wherein the stinger pipe comprises a second ball seat defining a second inner bore having a larger cross-sectional flow area than the inner bore defined by the ball seat, and flowing the cement through the stinger pipe comprises flowing the cement through the second inner bore defined by the second ball seat.

8. The method of claim 7, comprising, after allowing the cement to set and before rotating the drill bit through the orientation sub, dropping a second ball onto the second ball seat, thereby obstructing the second inner bore defined by the second ball seat and preventing the cement from flowing through the second inner bore defined by the second ball seat, the second ball having a larger diameter than the ball.

9. The method of claim 6, wherein the non-magnetic whipstock comprises a cylindrical portion connected to the ramp, and the cylindrical portion defines a second plurality of ports configured to allow cement to permeate throughout the cylindrical portion for further securing the non-magnetic whipstock in the wellbore before diverting the direction of the drill bit.

10. The method of claim 9, wherein the non-magnetic whipstock is made of a mixture of precast cement and at least one of carbon fiber, fiberglass, polymer, plastic, or ceramic.

11. A bottomhole assembly comprising:

an orientation sub configured to receive a gyroscopic orientation tool for orienting the orientation sub in a wellbore formed in a subterranean formation;

a non-magnetic whipstock coupled to the orientation sub and configured to rotate with the orientation sub, the non-magnetic whipstock comprising a ramp comprising a sloped surface configured to divert a direction of a drill bit that has drilled through the orientation sub for sidetracking from the wellbore and forming a secondary wellbore in the subterranean formation, wherein the ramp defines a plurality of ports configured to allow cement to permeate throughout the ramp for securing the non-magnetic whipstock in the wellbore before diverting the direction of the drill bit; and a stinger pipe configured to reversibly couple to the orientation sub, wherein the stinger pipe comprises a shear pin configured to keep the stinger pipe coupled to the orientation sub while the shear pin is intact, and the stinger pipe is configured to decouple from the orientation sub in response to the shear pin being sheared.

12. The bottomhole assembly of claim 11, wherein the stinger pipe comprises a ball seat defining an inner bore, the ball seat configured to receive a ball, wherein before receiving the ball, cement is allowed to flow through the inner bore defined by the ball seat, and wherein after receiving the ball, cement is prevented from flowing through the inner bore defined by the ball seat.

13. The bottomhole assembly of claim 11, wherein the stinger pipe comprises a second ball seat defining a second inner bore, the second ball seat configured to receive a second ball, wherein before receiving the second ball, cement is allowed to flow through the second inner bore defined by the second ball seat, wherein after receiving the second ball, cement is prevented from flowing through the second inner bore defined by the second ball seat, wherein the second ball has a larger diameter than the ball, and the second inner bore defined by the second ball seat has a larger cross-sectional flow area than the inner bore defined by the ball seat.

14. The bottomhole assembly of claim 11, wherein the non-magnetic whipstock comprises a cylindrical portion connected to the ramp, and the cylindrical portion defines a second plurality of ports configured to allow cement to permeate throughout the cylindrical portion for further securing the non-magnetic whipstock in the wellbore before diverting the direction of the drill bit.

15. The bottomhole assembly of claim 14, wherein the non-magnetic whipstock is made of a mixture of precast cement and at least one of carbon fiber, fiberglass, polymer, plastic, or ceramic.

16. A system comprising:

a wellbore formed in a subterranean formation;

an orientation sub positioned in the wellbore, the orientation sub configured to receive a gyroscopic orientation tool for orienting the orientation sub in the wellbore;

a stinger pipe reversibly coupled to the orientation sub, the stinger pipe comprising:

a shear pin configured to keep the stinger pipe coupled to the orientation sub while the shear pin is intact, the stinger pipe configured to decouple from the orientation sub in response to the shear pin being sheared; and a ball seat defining an inner bore, the ball seat configured to receive a ball, wherein before receiving the ball, cement is allowed to flow through the inner bore defined by the ball seat, and after receiving the ball, cement is prevented from flowing through the inner bore defined by the ball seat; and a non-magnetic whipstock coupled to the orientation sub and configured to rotate with the orientation sub, the non-magnetic whipstock comprising a ramp comprising a sloped surface configured to divert a direction of a drill bit that has drilled through the orientation sub for sidetracking from the wellbore and forming a secondary wellbore in the subterranean formation, wherein the ramp defines a plurality of ports configured to allow cement to permeate throughout the ramp for securing the non-magnetic whipstock in the wellbore before diverting the direction of the drill bit.

17. The system of claim 16, wherein the non-magnetic whipstock comprises a cylindrical portion connected to the ramp, and the cylindrical portion defines a second plurality of ports configured to allow cement to permeate throughout the cylindrical portion for further securing the non-magnetic whipstock in the wellbore before diverting the direction of the drill bit.

18. The system of claim 17, wherein the non-magnetic whipstock is made of a mixture of precast cement and at least one of carbon fiber, fiberglass, polymer, plastic, or ceramic.

* * * * *